US011117062B2

(12) United States Patent
Norman

(10) Patent No.: US 11,117,062 B2
(45) Date of Patent: Sep. 14, 2021

(54) SUPERCHARGED COLLECTABLE FIGURES FOR POWERING TOY ACCESSORIES

(71) Applicant: Genie Toys, plc, Cheltenham (GB)

(72) Inventor: Casey W. Norman, Cheltenham (GB)

(73) Assignee: Genie Toys, plc, Cheltenham (GB)

( * ) Notice: Subject to any disclaimer, the term of this patent is extended or adjusted under 35 U.S.C. 154(b) by 0 days.

(21) Appl. No.: 16/856,674

(22) Filed: Apr. 23, 2020

(65) Prior Publication Data

US 2020/0346124 A1 Nov. 5, 2020

Related U.S. Application Data

(60) Provisional application No. 62/841,875, filed on May 2, 2019.

(51) Int. Cl.

| | |
|---|---|
| ***A63H 3/36*** | (2006.01) |
| *A63H 3/28* | (2006.01) |
| *A63H 3/00* | (2006.01) |

(52) U.S. Cl.

CPC ..... *A63H 3/36* (2013.01); *A63H 3/006* (2013.01); *A63H 3/28* (2013.01)

(58) Field of Classification Search

CPC . A63H 3/36; A63H 3/28; A63H 3/006; A63H 33/26; A63H 3/005

USPC ..... 446/219, 236, 242–244, 268, 484, 485, 446/490

See application file for complete search history.

(56) References Cited

U.S. PATENT DOCUMENTS

| | | | | |
|---|---|---|---|---|
| 1,432,164 | A * | 10/1922 | Drufva | F21V 23/0414 362/204 |
| 2,098,166 | A * | 11/1937 | Rubenstein | A63H 3/48 446/337 |
| 6,074,266 | A * | 6/2000 | Zak | A23G 3/50 446/236 |
| 6,183,336 | B1 * | 2/2001 | Coleman | A23G 3/50 426/104 |
| 6,589,094 | B2 * | 7/2003 | Spencer | A63H 33/006 362/35 |
| 6,743,072 | B2 * | 6/2004 | Nelson | G09F 19/02 119/707 |
| 7,179,149 | B2 * | 2/2007 | Chernick | A63H 33/22 417/234 |
| 7,766,718 | B2 * | 8/2010 | Rago | A63H 1/24 446/242 |
| 8,408,951 | B1 * | 4/2013 | Chartrand | H01R 13/33 439/754 |
| 2004/0095758 | A1 * | 5/2004 | Hsien | F21L 4/005 362/204 |
| 2006/0072310 | A1 * | 4/2006 | Hung | A61B 1/00036 362/205 |

* cited by examiner

*Primary Examiner* — Nini F Legesse
(74) *Attorney, Agent, or Firm* — DLA Piper LLP (US)

(57) ABSTRACT

A playset having a battery housing and a receiving member is disclosed. The battery housing contains a battery and has at least one pair of recessed electrical contacts electrically connected to the battery. The receiving member has a chamber configured to receive the battery housing and an energizable element electrically connected to at least one pair of protruding electrical contacts protruding into the chamber. The battery housing is receivable by the receiving member such that the pair of recessed electrical contacts respectively electrically connect with the pair of protruding electrical contacts to supply power from the battery to the energizable element.

12 Claims, 5 Drawing Sheets

SUPERCHARGED COLLECTABLE FIGURES FOR POWERING TOY ACCESSORIES

TECHNICAL FIELD

This disclosure relates to a battery operated playset. Particularly, this disclosure relates to a playset including supercharged collectable figures that provide power and energy for toy accessories.

BACKGROUND

Battery operated toys, such as those that emit light or sound, are popular sources of amusement. However, as batteries may be hazardous for children, battery operated toys typically secure the battery within the toy to prevent removal of the battery by children. While securing the battery within the toy mitigates risk of harm, the security measures may make it difficult to change a battery when it is discharged or to share one battery among multiple toys. Accordingly, there is a need for a system that safely secures a battery while also allowing the battery to be easily inserted or removed during use.

SUMMARY

I provide a playset having a battery housing and a receiving member. The battery housing is adapted to contain a battery and has at least one pair of recessed electrical contacts electrically connected to the battery. The receiving member has a chamber configured to receive the battery housing and an energizable element electrically connected to at least one pair of protruding electrical contacts protruding into the chamber. The battery housing is receivable by the receiving member such that the pair of recessed electrical contacts respectively electrically connect with the pair of protruding electrical contacts to supply power from the battery to the energizable element.

DETAILED DESCRIPTION

This disclosure provides a playset including supercharged collectable figures that provide power and energy for toy accessories. The figures may be designed in the shape of a battery and decorated as superheroes, super villains and other characters. When the figures are attached to a toy accessory, such as a hat, body or vehicle, their unique form allows them to energize the accessory to provide lights, movement, sound and a host of other features.

Figure 1:
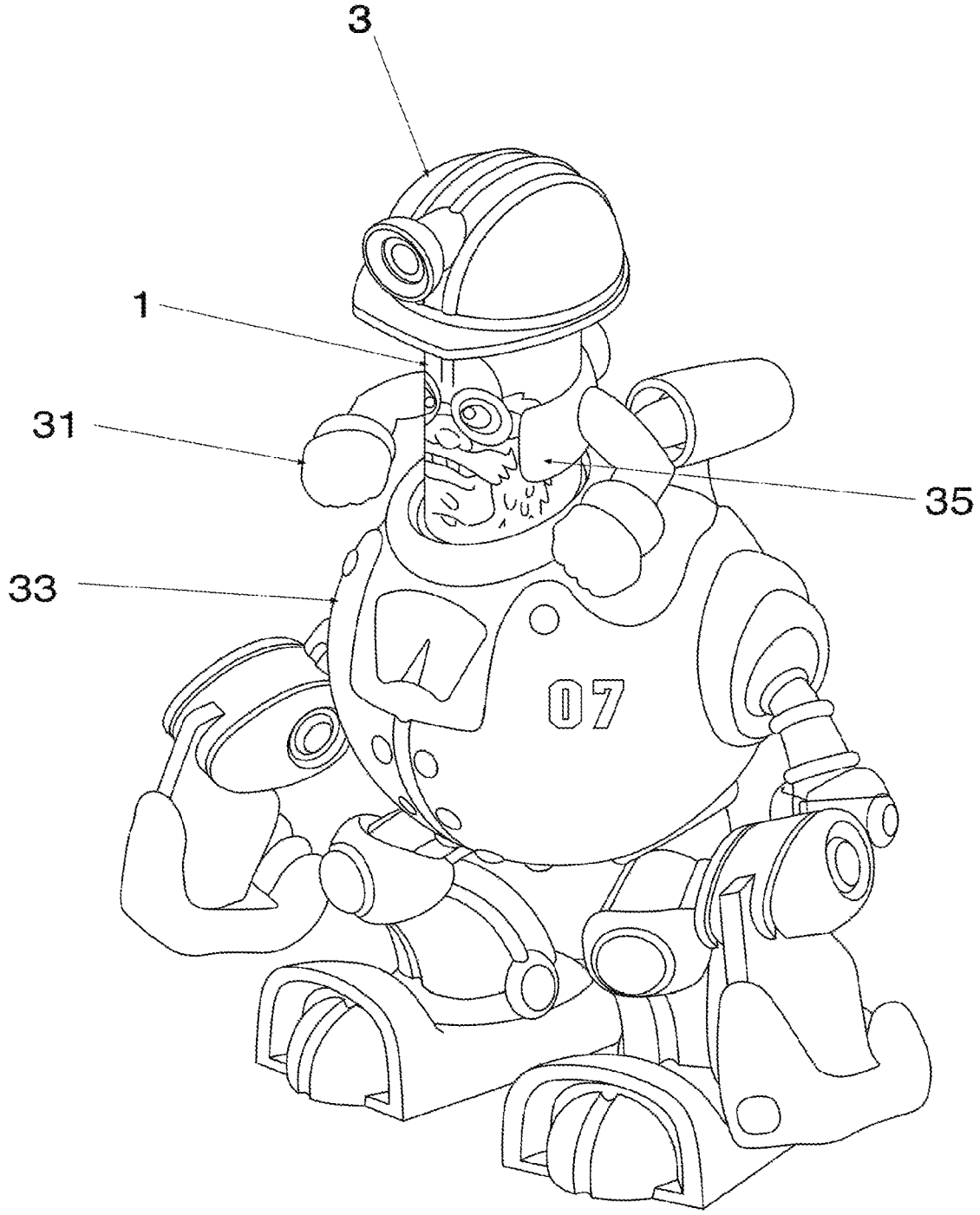
FIG. 1 is a perspective view of an exemplary playset.

FIG. 1 shows an exemplary playset 100 comprising the figures of this disclosure. The playset 100 includes at least one battery housing 1 and at least one receiving member 3.

Figure 2:
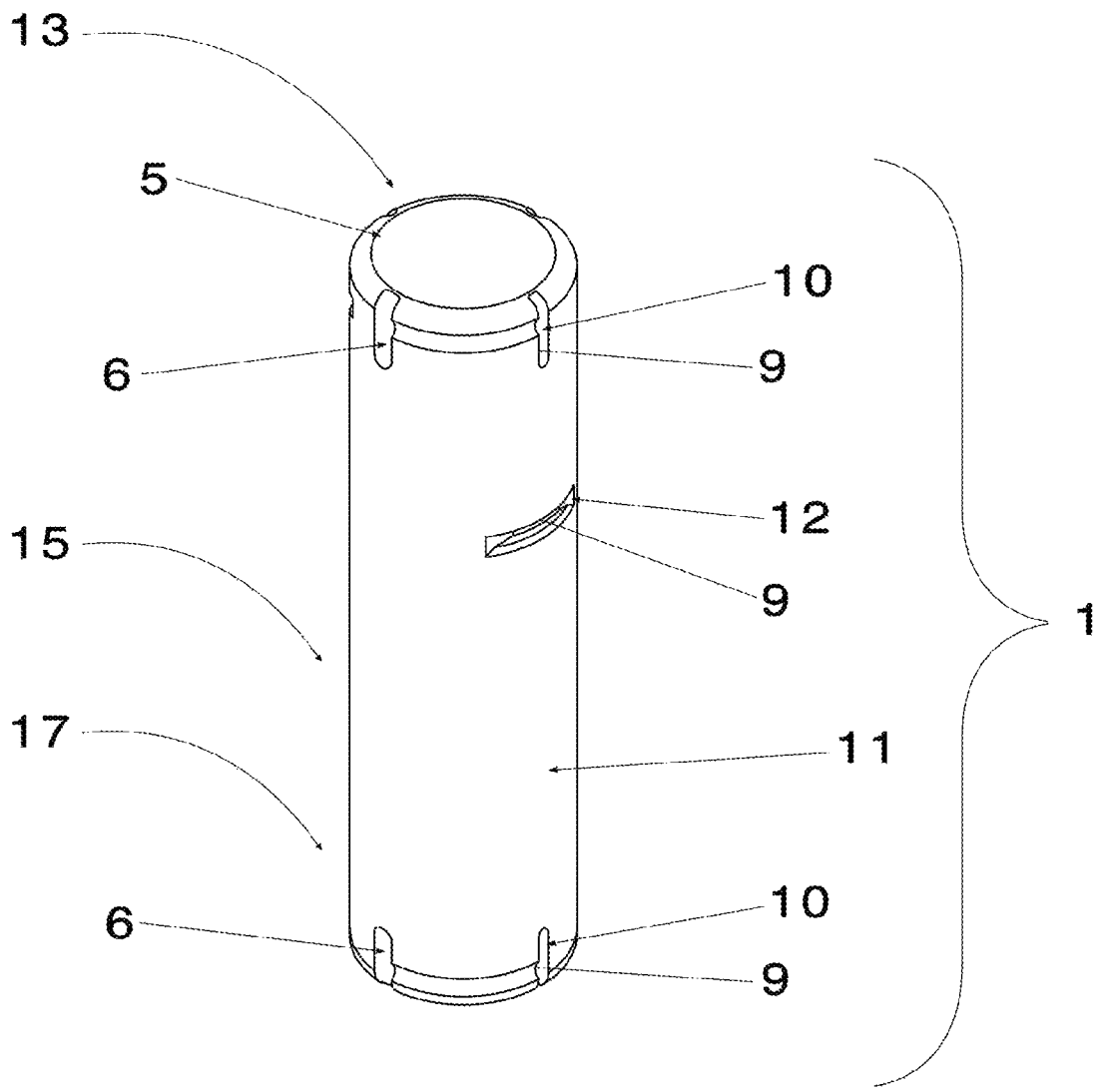
FIG. 2 is a perspective view of an exemplary battery housing of the playset.

As shown in FIG. 2, the battery housing 1 is a cylindrical tube having a lid 5 that houses a battery 7. However, the shape of the battery housing 1 is not limited to a cylindrical tube and it may be configured as other shapes, such as stylized figurines, for example. Optionally, the battery housing 1 may be sealed, preferably with a child-resistant sealing, to secure the battery and provide safe disposal. Optionally, the battery housing 1 may include location slots 6 or other structures to facilitate positioning or fitting of the battery housing 1 with respect to the receiving member 3 or other accessories.

Preferably, the battery housing 1 fully encases the battery 7. Suitable types of batteries for battery 7 include common conventional cylindrical cells, such as a AAA or AA batteries, or button cells. However, the battery 7 may be any type or shape of battery. The battery 7 may be a primary or secondary (i.e. rechargeable) cell, including a solar rechargeable battery. Additionally, it should be understood that the battery 7 may be comprised of two or more individual cells, such as two or more button cells stacked together.

Figure 3:
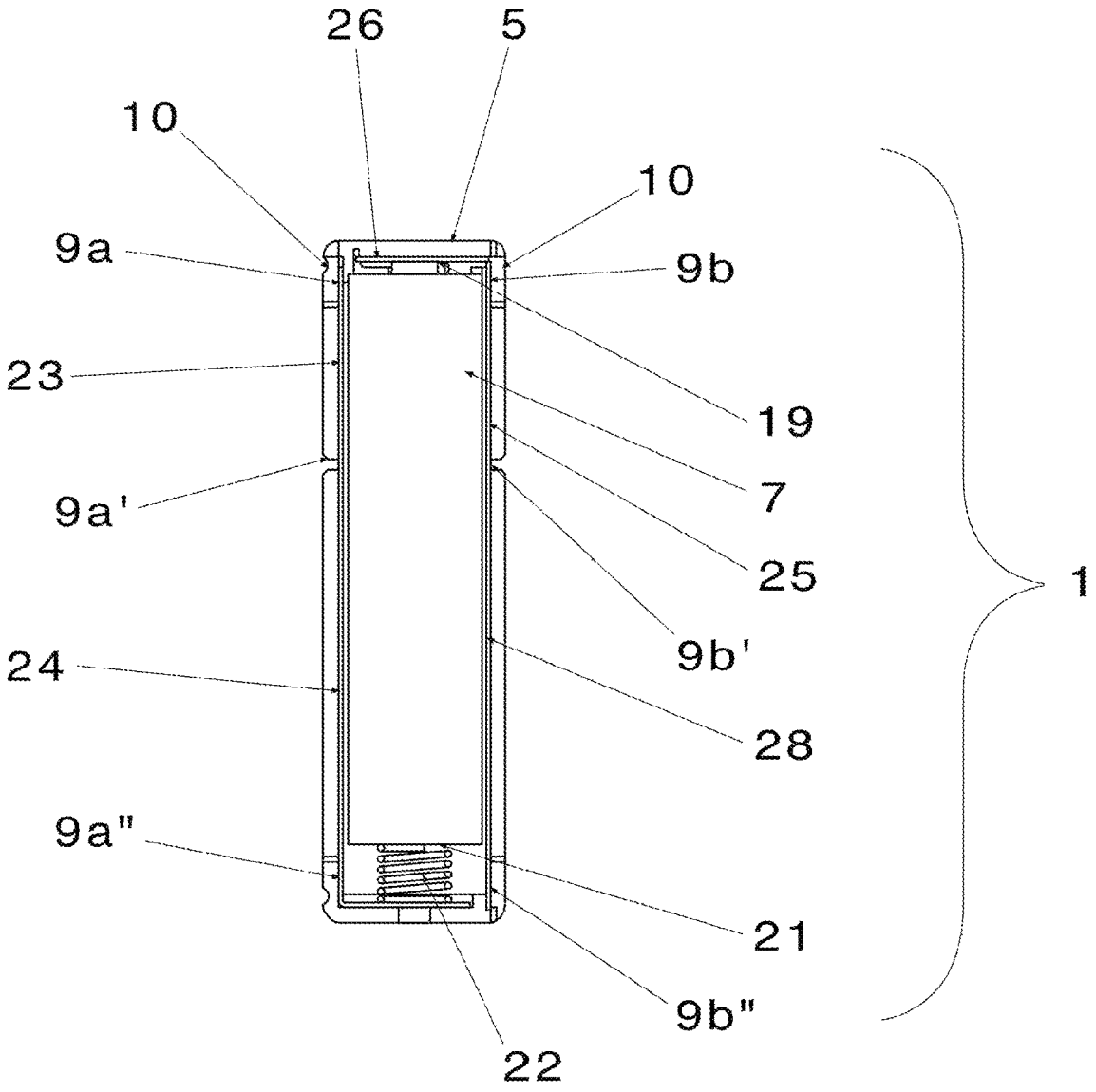
FIG. 3 is a cross-sectional view of the battery housing of FIG. 2.

As seen in FIGS. 2 and 3, the battery housing 1 includes at least one a pair of recessed electrical contacts 9 that are electrically connected to the battery 7. The recessed electrical contacts 9 may be recessed within recesses 10 in the battery housing 1. The recesses 10 may be in the form of openings 12.

The battery housing 1 as shown in FIG. 3 has three pairs of recessed electrical contacts 9. A first pair of recessed electrical contacts 9*a*, 9*b* is positioned in the outer circumferential wall 11 of the battery housing 1 in a top end region 13 of the battery housing 1 nearest the lid 5. A second pair of recessed electrical contacts 9*a*', 9*b*' is positioned in the outer circumferential wall 11 of the battery housing 1 in a middle region 15 of the battery housing 1. A third pair of recessed electrical contacts 9*a*", 9*b*" is positioned in the outer circumferential wall 11 of the battery housing 1 in a bottom end region 17 of the battery housing 1 furthest from the lid 5. Other configurations are possible without departing from the scope of this disclosure.

Each pair of recessed electrical contacts 9 includes a negative recessed electrical contact 9*a* and a positive recessed electrical contact 9*b*. The negative recessed electrical contact 9*a* is electrically connected to a negative terminal 19 of the battery 7 via a conductive negative contact 23. The positive recessed electrical contact 9*b* is electrically connected to a positive terminal 21 of the battery 7 via a conductive positive contact 25. The positive contact 25 and negative contact 23 are electrically insulated from one another.

When the battery housing contains multiple pairs of recessed electrical contacts 9, the negative contact 23 preferably electrically connects each negative recessed electrical contact 9*a* to the negative terminal 19 of battery 7. As shown in FIG. 3, the negative contact 23 includes a conductive metal spring 22 electrically connecting the negative terminal 19 of battery 7 to a conductive metal strip 24 which is, in turn, electrically connected to each of negative recessed electrical contacts 9*a*, 9*a*' and 9*a*" in series. However, alternative structures of the negative contact 23 for connecting the negative recessed electrical contact 9*a* to the battery 7 may be used.

Likewise, when the battery housing contains multiple pairs of recessed electrical contacts 9, the positive contact 25 preferably electrically connects each positive recessed electrical contact 9*b* to the positive terminal 21 of battery 7. As shown in FIG. 3, the positive contact 25 includes a conductive metal plate 26 in lid 5 electrically connecting the positive terminal 21 of battery 7 to a conductive metal strip 28 which is, in turn, electrically connected to each of positive recessed electrical contacts 9*b*, 9*b*' and 9*b*" in series. However, alternative structures of the positive contact 25 for connecting the positive recessed electrical contact 9*b* to the battery 7 may be used.

Figure 4:
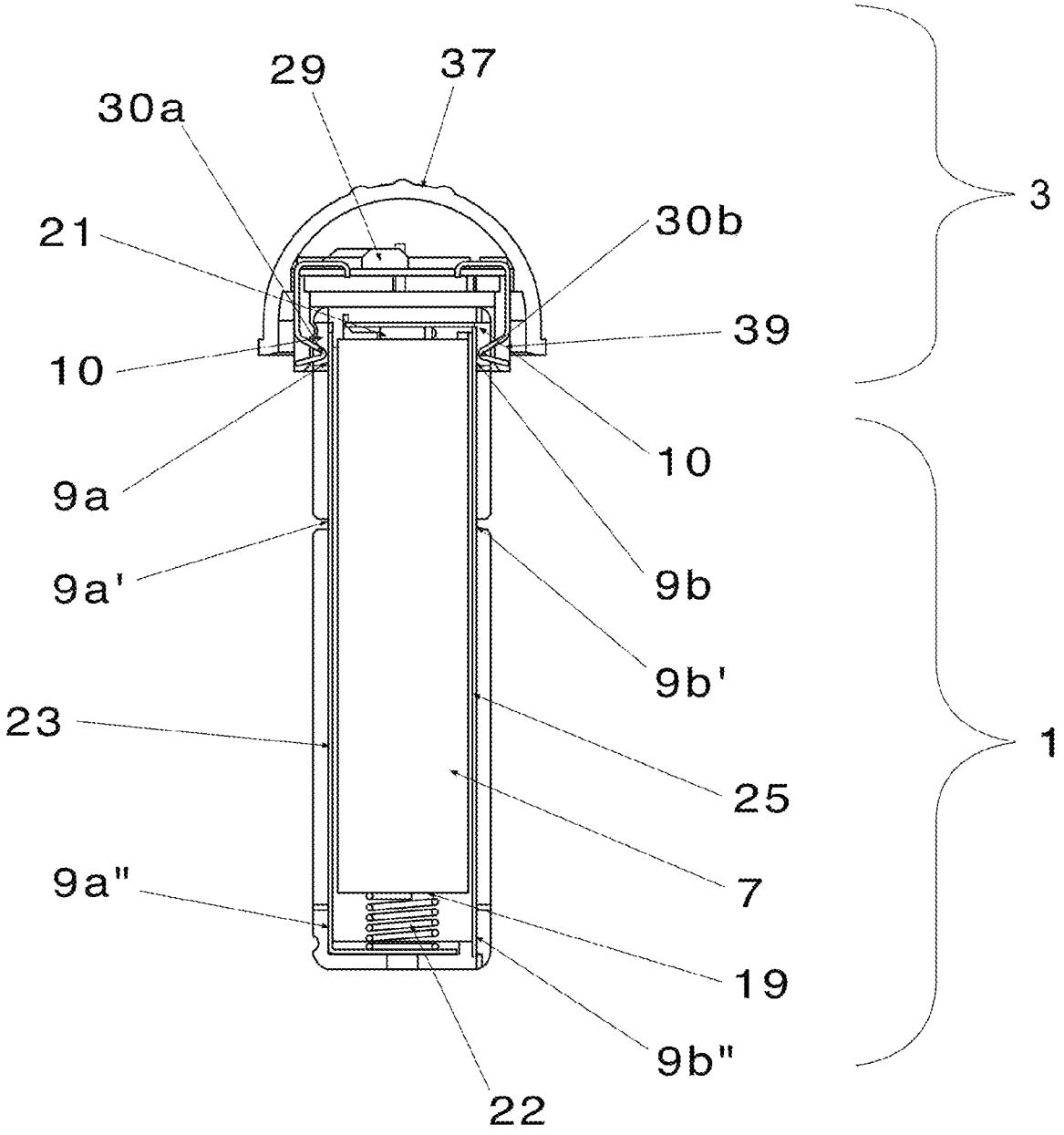
FIG. 4 is a cross-sectional view of the exemplary battery housing engaged with an exemplary receiving member of the playset.
Figure 5:
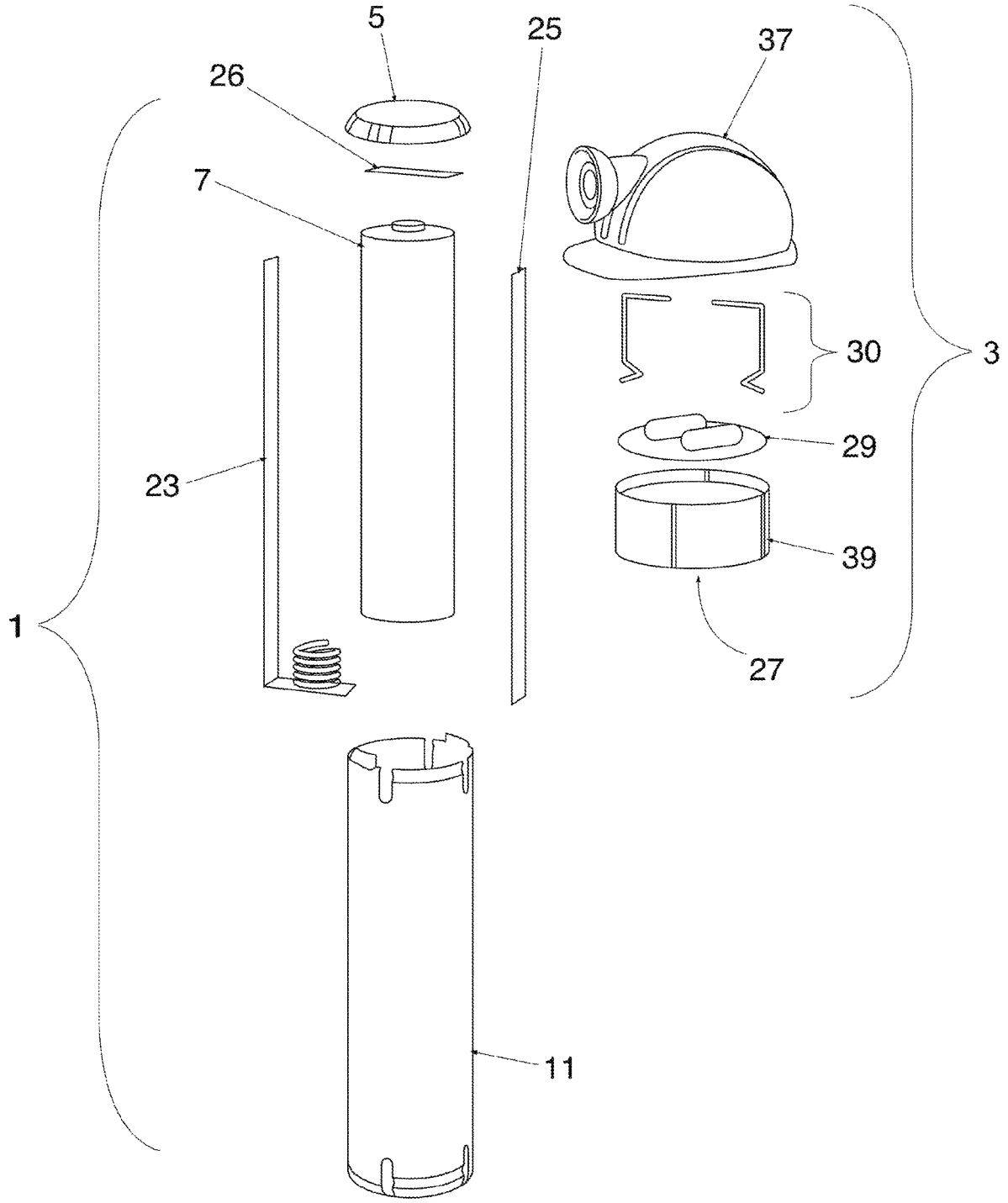
FIG. 5 is an exploded view of the playset.

Turning to FIGS. 4 and 5, the playset 100 includes a receiving member 3, depicted by example as having an outer housing 37 in the form of a construction-style safety helmet. The receiving member 3 has a chamber 27 defined in an inner casing 39 and at least one energizable element 29 electrically connected to a pair of protruding electrical contacts 30. The pair of protruding electrical contacts 30 includes a negative protruding electrical contact 30*a* and a positive protruding electrical contact 30*b*. The protruding electrical contacts 30 are made of conductive material and protrude radially inward into the chamber 27 of the receiving member 3 (see also, FIG. 3).

The battery housing 1 is receivable by the receiving member 3 whereby the pair of recessed electrical contacts 9*a* and 9*b* respectively electrically connect to the pair of protruding electrical contacts 30*a* and 30*b*. Specifically, when the battery housing 1 is received within the receiving member 3 as shown in FIG. 4, the negative protruding electrical contact 30*a* of the receiving member 3 protrudes into a recess 10 and electrically connects to the negative recessed electrical contact 9*a* of the battery housing 1. Likewise, the positive protruding electrical contact 30*b* of the receiving member 3 protrudes into a recess 10 and electrically connects to the positive recessed electrical contact 9*b* of the battery housing 1.

As a result, the negative protruding electrical contact 30*a* may achieve an electrical connection with the negative terminal 19 of the battery 7 via the negative contact 23 and, likewise, the positive protruding electrical contact 30*b* may achieve an electrical connection with the positive terminal 21 of the battery 7 via the positive contact 25. Further, as the pair of protruding electrical contacts 30 is electrically connected to the energizable element 29, the electrical connection of the pair of recessed electrical contacts 9*a* and 9*b* with the pair of protruding electrical contacts 30*a* and 30*b* brings the energizable element 29 into electrical connection with the battery 7 and completes the circuit. Consequently, the battery 7 can supply power to energize or activate the energizable element 29.

The energizable element 29 may be any battery operated device, such as those emitting light or sound or activating a movable element or the like. Suitable examples include but are not limited to a lightsource, such as an LED, a speaker or piezo buzzer, or a motor, such as a rotary motor. For example, the receiving member 3 depicted in FIG. 1 is an LED. Additionally, the energizable element 29 may include a sensor, such as a sensor capable of detecting light, proximity, temperature and infrared.

As shown in FIG. 1, the playset 100 may include a plurality of receiving members 3. As shown, a first receiving member 3 is in the form of a construction-style safety helmet, a second receiving member 31 is in the form of a set of stylized arms and a third receiving member 33 is in the form of a robot body. However, the shape of the receiving members are not limited and may take on other forms.

The first receiving member 3 engages with the first pair of recessed electrical contacts 9 positioned in the outer circumferential wall 11 of the battery housing 1 in a top end region 13 of the battery housing 1 nearest the lid 5. The second receiving member 31 engages with a second pair of recessed electrical contacts 9' positioned in the outer circumferential wall 11 of the battery housing 1 in a middle region 15 of the battery housing 1. The third receiving member 33 engages with the third pair of recessed electrical contacts 9" positioned in the outer circumferential wall 11 of the battery housing 1 in a bottom end region 17 of the battery housing 1 furthest from the lid 5. As shown, the second receiving member 31 has a fastener 35 configured to fasten the second receiving member 31 to the battery housing 1.

Additionally, the playset 100 may comprise a plurality of battery housings 1, each having a battery 7. In some examples, the use of multiple battery housings may proportionally increase the amount of energy supplied to the energizable elements to heighten the enjoyment of the playset, such as by increasing the speed of a moveable portion of the receiving element 3. Additionally, facing a battery housing backwards in a receiving member may drive motors in reverse.

What is claimed is:

1. A playset comprising:

a battery housing adapted to contain a battery and having at least one pair of recessed electrical contacts electrically connected to the battery; and a receiving member having a chamber configured to receive the battery housing and an energizable element electrically connected to at least one pair of protruding electrical contacts protruding into the chamber, wherein the battery housing is receivable by the receiving member whereby the at least one pair of recessed electrical contacts respectively electrically connect with the at least one pair of protruding electrical contacts to supply power from the battery to the energizable element.

2. The playset according to claim 1, wherein, when the battery housing is received by the receiving member, the at least one pair of protruding electrical contacts respectively protrude into at least one pair of recesses.

3. The playset according to claim 1, wherein each of the at least one pair of recessed electrical contacts are recessed within openings in the battery housing.

4. The playset according to claim 1, wherein the at least one pair of recessed electrical contacts are positioned along a circumferential wall of the battery housing.

5. The playset according to claim 4, further comprising a second receiving member having a fastener configured to fasten the second receiving member to the battery housing and engage the at least one pair of recessed electrical contacts positioned along the circumferential wall of the battery housing.

6. The playset according to claim 1, wherein the at least one pair of recessed electrical contacts are positioned in an end region of the battery housing.

7. The playset according to claim 1, wherein the at least one pair of recessed electrical contacts are positioned in a middle region of the battery housing.

8. The playset according to claim 1, wherein the battery housing comprises a plurality of pairs of recessed electrical contacts.

9. The playset according to claim 1, wherein the energizable member is at least one selected from the group of a lightsource, a speaker, a buzzer and a motor.

10. The playset according to claim 1, wherein the battery housing is cylindrical.

11. The playset according to claim 1, wherein the playset comprises more than one battery housing.

12. The playset according to claim 1, wherein the playset comprises a plurality of receiving members.

* * * * *